US010246762B2

(12) United States Patent
Goto et al.

(10) Patent No.: US 10,246,762 B2
(45) Date of Patent: Apr. 2, 2019

(54) ALUMINUM ALLOY ELECTRIC WIRE AND AUTOMOTIVE WIRE HARNESS USING THE SAME

(71) Applicant: Yazaki Corporation, Tokyo (JP)

(72) Inventors: Jundai Goto, Shizuoka (JP); Yuuki Yamamoto, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/615,886

(22) Filed: Jun. 7, 2017

(65) Prior Publication Data

US 2017/0356069 A1 Dec. 14, 2017

(30) Foreign Application Priority Data

Jun. 9, 2016 (JP) ..... 2016-115230

(51) Int. Cl.

| | |
|---|---|
| ***H01B 7/00*** | (2006.01) |
| ***C22C 21/08*** | (2006.01) |
| ***H01B 1/02*** | (2006.01) |
| ***H01B 5/02*** | (2006.01) |

(52) U.S. Cl.

CPC ..... *C22C 21/08* (2013.01); *H01B 1/02* (2013.01); *H01B 5/02* (2013.01); *H01B 7/0045* (2013.01)

(58) Field of Classification Search

CPC ..... H01B 1/026; H01B 1/023
USPC ..... 174/126.1, 126.2; 148/502, 439
See application file for complete search history.

(56) References Cited

U.S. PATENT DOCUMENTS

2013/0126051 A1* 5/2013 Sekiya ..... C22C 21/00 148/502
2013/0264115 A1 10/2013 Kobayashi et al.
2014/0020796 A1* 1/2014 Sekiya ..... H01B 1/023 148/550
2014/0311769 A1* 10/2014 In ..... C22C 5/06 174/126.2
2015/0235729 A1 8/2015 Yoshida et al.
2016/0358685 A1 12/2016 Yoshida et al.
(Continued)

FOREIGN PATENT DOCUMENTS

CN 103298963 A 9/2013
JP 2010-077535 A 4/2010
(Continued)

OTHER PUBLICATIONS

Communication dated Jun. 5, 2018 from the Japanese Patent Office in counterpart application no. 2016- 115230. Machine translation.
(Continued)

*Primary Examiner* — William H. Mayo, III
(74) *Attorney, Agent, or Firm* — Sughrue Mion, PLLC

(57) ABSTRACT

An aluminum alloy electric wire includes an aluminum alloy strand that contains Mg, Si and a remainder composed of aluminum and inevitable impurities. The aluminum alloy strand contains 0.6 to 1.4 atomic % of Mg and 0.2 to 1.0 atomic % of Si, has a coefficient of variation of 0.8 or less, the coefficient being calculated by dividing a standard deviation of a grain size of crystal grains observed on a cross section by an average grain size of the crystal grains, has tensile strength of 165 MPa or more, has elongation at break of 7% or more, and has conductivity of 40% IACS or more.

5 Claims, 5 Drawing Sheets

(56) References Cited

U.S. PATENT DOCUMENTS

| | | | |
|---|---|---|---|
| 2017/0098487 | A1 | 4/2017 | Kobayashi et al. |
| 2017/0226615 | A1 | 8/2017 | Imasato et al. |
| 2017/0250000 | A1 | 8/2017 | Sekiya et al. |

FOREIGN PATENT DOCUMENTS

| | | | | | |
|---|---|---|---|---|---|
| JP | WO2012/141041 | A1 * | 10/2012 | ..... | H01B 5/04 |
| JP | 5128109 | B2 | 1/2013 | | |
| JP | 2013-44038 | A | 3/2013 | | |
| JP | 2013-129889 | A | 7/2013 | | |
| JP | 2015-124409 | A | 7/2015 | | |
| WO | 2014/155820 | A1 | 10/2014 | | |
| WO | 2015/133004 | A1 | 9/2015 | | |
| WO | 2016/027550 | A1 | 2/2016 | | |
| WO | 2016/088888 | A1 | 6/2016 | | |

OTHER PUBLICATIONS

Communication dated Dec. 6, 2018 from the State Intellectual Property Office of the P.R.C. in application No. 201710433168.5 Machine Translation.

Communication dated Nov. 27, 2018 from the Japanese Patent Office in application No. 2016-115230 Machine Translation.

Communication dated Aug. 24, 2018 issued by the State Intellectual Property Office of the People's Republic of China in counterpart application No. 201710433168.5 Translation.

* cited by examiner

ALUMINUM ALLOY ELECTRIC WIRE AND AUTOMOTIVE WIRE HARNESS USING THE SAME

CROSS REFERENCE TO RELATED APPLICATION

This application is based upon and claims the benefit of priority from the prior Japanese Patent Application No. 2016-115230, filed on Jun. 9, 2016, the entire contents of which are incorporated herein by reference.

BACKGROUND

1. Technical Field

The present invention relates to an aluminum alloy electric wire for use in an automotive wire harness and the like, and to an automotive wire harness using the same.

2. Related Art

An aluminum alloy electric wire including an aluminum alloy strand is known as an electric wire for use in an automotive wire harness and the like.

In recent years, it has been desired to reduce a diameter of an aluminum alloy electric wire in order to reduce weight of an automobile. An electric wire with a smallest diameter in JASO D 603, which is a standard for the present automotive aluminum alloy electric wires, is an electric wire in which a cross-sectional area of an aluminum alloy stranded wire conductor as a bundle of a plurality of the aluminum alloy strands is 0.75 sq ($mm^2$). Moreover, in this standard, as performance required for the aluminum alloy strand that composes the aluminum alloy stranded wire conductor with a cross-sectional area of 0.75 sq, there are prescribed tensile strength of 70 MPa or more, elongation at break of 10% or more, and conductivity of 58% IACS or more.

As a conventional technology regarding the aluminum alloy strand, Japanese Unexamined Patent Publication No. 2010-77535 describes an aluminum alloy wire that contains predetermined amounts of Mg, Si and Cu, in which conductivity is 58% IACS or more, and elongation is 10% or more. Moreover, an embodiment of Japanese Unexamined Patent Publication No. 2010-77535 describes an aluminum alloy wire with tensile strength of 124 to 134 MPa.

Moreover, Japanese Patent No. 5128109 describes an aluminum electric wire conductor, which is composed by twisting a plurality of aluminum alloy strands, and contains predetermined amounts of Mg and Si, in which tensile strength is 240 MPa or more, elongation at break is 10% or more, and conductivity is 40% IACS or more.

Furthermore, Japanese Unexamined Patent Publication No. 2013-44038 describes an aluminum alloy wire that contains Fe, Mg and Si, in which tensile strength is less than 240 MPa, and elongation at break is 10% or more.

Incidentally, since the weight of the automobile is needed to be reduced, it has been desired to further reduce the diameter of the aluminum alloy electric wire. Aluminum alloy electric wires, which are expected to appear in the future with reference to a size of the automotive copper electric wire prescribed in JASO D 611, are those in which cross-sectional areas of the aluminum alloy stranded wire conductor are 0.5 sq, 0.35 sq, 0.22 sq, 0.13 sq and the like.

However, if the cross-sectional area of the aluminum alloy stranded wire conductor is reduced, then a load capacity of the aluminum alloy electric wire is decreased. Therefore, in order that the aluminum alloy electric wire can have a sufficient load capacity, it is necessary to increased strength of the aluminum alloy strand. For example, in order that an aluminum alloy electric wire, in which such a cross-sectional area of the aluminum alloy stranded wire conductor is 0.5 sq or less, can obtain a load capacity equivalent to that of an aluminum alloy electric wire, in which a cross-sectional area of the aluminum alloy stranded wire conductor is 0.75 sq, it seems necessary that the tensile strength of the aluminum alloy strand be 165 MPa or more.

Moreover, in order that the aluminum alloy electric wires can be used in an automotive application such as an automotive wire harness, it is necessary that the aluminum alloy strand have appropriate elongation at break and conductivity in addition to high strength.

On the other hand, the aluminum alloy strand in Japanese Unexamined Patent Publication No. 2010-77535 has low strength. Accordingly, when such an aluminum alloy electric wire, in which a cross-sectional area of the aluminum alloy stranded wire conductor is smaller than 0.75 sq, is produced, the strength of the aluminum alloy electric wire is expected to be insufficient.

Moreover, in the aluminum alloy strand in Japanese Patent No. 5128109, when a wire diameter is set to φ0.32 mm, then the number of crystal grains observed on a cross section of the strand is decreased, and the elongation at break is decreased. Therefore, if the aluminum alloy electric wire, in which the cross-sectional area of the aluminum alloy stranded wire conductor is smaller than 0.75 sq, is produced from this strand, then it is apprehended that such ductility of the aluminum alloy electric wire may be insufficient.

Furthermore, Fe is added to the aluminum alloy strand of Japanese Unexamined Patent Publication No. 2013-44038. Therefore, if the aluminum alloy electric wire, in which the cross-sectional area of the aluminum alloy stranded wire conductor is smaller than 0.75 sq, is produced from this strand, then it is apprehended that the conductivity of the aluminum alloy electric wire may be decreased.

SUMMARY

The present invention has been made in consideration of the above-described circumstances, and it is an object of the present invention to provide an aluminum alloy electric wire including an aluminum alloy strand having characteristics in which tensile strength is 165 MPa or more, elongation at break is 7% or more, and conductivity is 40% IACS or more. Note that these characteristics are characteristics which seem to satisfy such properties required for the aluminum alloy strand that composes the aluminum alloy electric wire in which the cross-sectional area of the aluminum alloy stranded wire conductor is 0.5 sq or less.

An aluminum alloy electric wire according to a first aspect of the present invention is an aluminum alloy electric wire including an aluminum alloy strand that contains Mg, Si and a remainder composed of aluminum and inevitable impurities, characterized in that the aluminum alloy strand contains 0.6 to 1.4 atomic % of Mg and 0.2 to 1.0 atomic % of Si, has a coefficient of variation of 0.8 or less, the coefficient being calculated by dividing a standard deviation of a grain size of crystal grains observed on a cross section by an average grain size of the crystal grains, has tensile strength of 165 MPa or more, has elongation at break of 7% or more, and has conductivity of 40% IACS or more.

An automotive wire harness according to a second aspect of the present invention is characterized in that the aluminum alloy electric wire is used.

BRIEF DESCRIPTION OF DRAWINGS

The figures depict one or more implementations in accordance with the present teaching, by way of example only, not by way of limitations. In the figures, like reference numerals refer to the same or similar elements.

DETAILED DESCRIPTION

Figure 1:
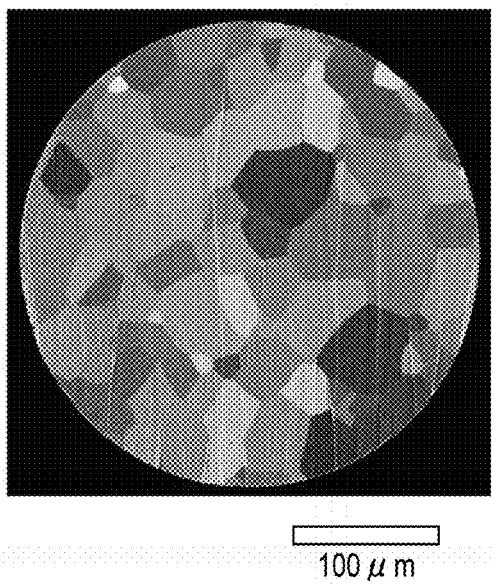
FIG. 1 is an SEM (scanning electron microscope) photograph of a cross section of a wire of an aluminum alloy strand of Example 1.

Hereinafter, a specific description will be made of an aluminum alloy electric wire of this embodiment with reference to the drawings.

[Aluminum Alloy Electric Wire]

The aluminum alloy electric wire of this embodiment includes an aluminum alloy stranded wire conductor, and the aluminum alloy stranded wire conductor includes an aluminum alloy strand. Specifically, the aluminum alloy electric wire of this embodiment includes an aluminum alloy stranded wire conductor obtained by twisting a plurality of the aluminum alloy strands, and an insulating resin layer that covers a surface of the aluminum alloy stranded wire conductor.

(Aluminum Alloy Strand)

The aluminum alloy strand for use in this embodiment is a wire composed of an aluminum alloy containing aluminum as a main component. Specifically, the aluminum alloy strand contains Mg and Si, in which a remainder is composed of aluminum and inevitable impurities.

Mg binds with Si to precipitate $Mg_2Si$ grains and the like finely in an Al matrix of the aluminum alloy strand, thereby increasing strength of the aluminum alloy strand. The aluminum alloy strand contains 0.6 to 1.4 atomic % of Mg, preferably 0.6 to 1.0 atomic % thereof. When the aluminum alloy strand contains Mg within the above-described range, the strength of the aluminum alloy strand tends to be increased.

Si binds with Mg to precipitate the $Mg_2Si$ grains and the like finely in the Al matrix of the aluminum alloy strand, thereby increasing the strength of the aluminum alloy strand. The aluminum alloy strand contains 0.2 to 1.0 atomic % of Si, preferably 0.4 to 0.7 atomic % thereof. When the aluminum alloy strand contains Si within the above-described range, the strength of the aluminum alloy strand tends to be increased.

The aluminum alloy strand contains 0.8 to 1.8 atomic % of a total amount of Mg and Si, preferably 0.9 to 1.5 atomic % thereof. When the aluminum alloy strand contains the total amount of Mg and Si within the above-described range, the strength of the aluminum alloy strand tends to be increased.

In the aluminum alloy strand, an Mg/Si ratio, which is a ratio of atomic % of Mg to atomic % of Si, is preferably 0.8 to 3.5, more preferably 1.1 to 2.0. When the Mg/Si ratio of the aluminum alloy strand is within the above-described range, the strength of the aluminum alloy strand tends to be increased.

The aluminum alloy strand contains inevitable impurities other than Al, Mg and Si in some cases. As the inevitable impurities, for example, there are mentioned iron (Fe), zirconium (Zr), copper (Cu), zinc (Zn), nickel (Ni), manganese (Mn), rubidium (Rb), chromium (Cr), titanium (Ti), tin (Sn), vanadium (V), gallium (Ga), boron (B), and sodium (Na).

With regard to the aluminum alloy strand, it is more preferable that the number of abnormally grown grains, which are crystal grains in which a crystal grain size in a cross-sectional direction of the aluminum alloy strand is abnormally large (that is, the grain size is largely deviated from an average grain size), be smaller. If the number of abnormally grown grains of the aluminum alloy strand is small as described above, then when tensile deformation occurs in the aluminum alloy strand, a stress concentration is unlikely to occur in the aluminum alloy strand, and ductility of the aluminum alloy strand is increased. In the present invention, as an index indicating the number of abnormally grown grains, there is used a coefficient of variation, which is calculated by dividing a standard deviation of the grain size of the crystal grains, which are observed on the cross section of the aluminum alloy strand, by the average grain size of the crystal grains. The smaller this coefficient of variation is, the smaller the number of abnormally grown grains is, and it is easy to obtain an aluminum alloy strand having large elongation at break.

The aluminum alloy strand has tensile strength of usually 165 MPa or more, preferably 180 MPa or more. A reason why the tensile strength of the aluminum alloy strand for use in this embodiment is increased as described above seems to be that an action of precipitation hardening works strongly since a size of a precipitate in a metallographic structure of the aluminum alloy strand is small and a number density of the precipitate in the metallographic structure is large.

The aluminum alloy strand has conductivity of usually 40% IACS or more, preferably 48% IACS or more, more preferably 50% IACS or more.

The aluminum alloy strand has elongation at break of 7% or more, preferably 10% or more. A reason why the elongation at break of the aluminum alloy strand is increased as described above seems to be that a large number of the crystal grains are formed in a diameter direction of the cross section of the aluminum alloy strand to have a uniform grain size by an energization heating step, whereby a local stress concentration in an inside of the wire is relieved at a time when the aluminum alloy strand is deformed.

The aluminum alloy strand for use in this embodiment can be obtained by performing a solution heat treatment step, a final wire drawing step, a twisting step, an energization heating step and an aging treatment step, for example, for an aluminum alloy wire rod. Hereinafter, a production method of this aluminum alloy electric wire will be described.

[Production Method of Aluminum Alloy Electric Wire]

(Aluminum Alloy Wire Rod)

The aluminum alloy wire rod is a wire obtained by roughly drawing an aluminum alloy or an aluminum alloy obtained by melting and casting a raw material thereof. As the aluminum alloy, for example, there is used an aluminum alloy having the same composition as the aluminum alloy strand that composes the aluminum alloy electric wire of this embodiment. A roughly drawing method of the aluminum alloy is not particularly limited, and a method known in public can be used.

The aluminum alloy wire rod usually has a circular cross section or a polygonal cross section such as a triangular or quadrangular cross section. When the cross section of the aluminum alloy wire rod is circular, a size (diameter) of the cross section of the aluminum alloy wire rod is, for example, 5 to 30 mm, preferably 7 to 15 mm.

The above-described aluminum alloy wire rod is a raw material for the solution heat treatment step that is a next step.

(Solution Heat Treatment Step)

The solution heat treatment step is a step of uniformly dissolving an element, which is not sufficiently dissolved in an aluminum parent phase, in the aluminum parent phase, the element belonging to the wire that is not still subjected to the solution heat treatment. Conditions for the solution heat treatment step are not particularly limited, and conditions known in public can be used.

(Final Wire Drawing Step)

The final wire drawing step is a step of drawing the solution-heat-treated wire rod, which is obtained in the solution heat treatment step, to a final wire diameter. By the final wire drawing step, the crystal grains in the solution-heat-treated wire can be refined. As such a wire drawing method in the final wire drawing step, a dry wire drawing method or a wet wire drawing method, which is known in public, is used. The finally drawn wire that is the wire obtained in the final wire drawing step usually has a circular cross-sectional shape. The wire diameter (diameter) φ of the finally drawn wire is, for example, 0.1 to 0.5 mm, preferably 0.15 to 0.35 mm.

(Twisting Step)

The twisting step is a step of twisting a plurality of the finally drawn wires obtained in the final wire drawing step.

(Energization Heating Step)

The energization heating step is a step of giving Joule heat, which corresponds to an operation of giving energy of $2.6\times10^9$ to $4.4\times10^9$ J/m$^3$ per unit volume for a time of 0.2 to 0.3 second to a stranded wire conductor, which is obtained in the twisting step. However, such a condition example shown here is not the only condition of the energization heating step, and for example, it is also possible to further increase an applied voltage at the time of the energization heating, and to further shorten the energization time. By the energization heating step, the precipitate present in the stranded wire conductor can be solid-dissolved into the parent phase, the crystal grains can be enlarged, and in addition, the ductility can be recovered by removing a strain of the metalorganic structure of the stranded wire conductor. Moreover, it is also possible to implement this step for the strand immediately before the twisting step.

As a heating method in this step, in-line heating is usually used, in which heating is performed while moving the stranded wire conductor. In the in-line heating, a facility/method and condition setting, which enable heating for an extremely short time, are preferable. If the stranded wire conductor is heated by the energization heating, then such heating is performed in an extremely short time, whereby a processing strain can be removed while suppressing an occurrence of the abnormally grown grains, and accordingly, the elongation at break of the aluminum alloy strand already subjected to the aging treatment to be described layer can be increased. Moreover, the energizing heating also combines an effect equivalent to that of the solution heat treatment, and it can be expected that the strength after aging is increased by performing the energization heating step.

For example, continuous energization heat treatment is used as a method of the energization heating. Here, the continuous energization heat treatment is treatment in which a stranded wire conductor continuously passes through two electrode rings to flow an electric current through the stranded wire conductor and generate Joule heat in the stranded wire conductor, and the stranded wire conductor is continuously annealed by this Joule heat.

The energization-heated stranded wire conductor obtained through the energization heating of the stranded wire conductor has substantially the same composition as that of the stranded wire conductor; however, a part or all of a processing strain in an inside thereof is removed, recrystallized grains are formed therein, and moderate flexibility is given thereto. The energization-heated stranded wire conductor is a raw material for the aging treatment step that is the next step.

(Aging Treatment Step)

The aging treatment step is a step of performing aging treatment for the energization-heated stranded wire conductor, which is obtained in the energization heating step at 130 to 190° C. for 15 hours or less. The aging treatment step is a step of attaining age hardening of the stranded wire conductor by forming a fine precipitate such as Mg—Si in the crystal grains of the aluminum alloy that composes the energization-heated stranded wire conductor. The stranded wire conductor obtained through the aging treatment step is an aluminum alloy stranded wire conductor that composes the aluminum alloy electric wire of this embodiment. Moreover, the strand that composes the aluminum alloy stranded wire conductor is the aluminum alloy strand that composes the aluminum alloy electric wire of this embodiment.

A treatment temperature of the aging treatment is 120 to 190° C., preferably 130 to 180° C. When the treatment temperature of the aging treatment is within this range, the obtained aluminum alloy stranded wire conductor has appropriate tensile strength and elongation at break.

A treatment time of the aging treatment is 15 hours or less, preferably 8 hours or less. When the treatment time of the aging treatment is within this range, the obtained aluminum alloy stranded wire conductor has appropriate tensile strength and elongation at break.

Note that, when the wire drawing step, the solution heat treatment step and the aging treatment step are performed in order to produce the aluminum alloy stranded wire conductor, the treatment is generally performed in this order. In contrast, in the production method of the aluminum alloy electric wire of this embodiment, the treatment is performed in the order of the solution heat treatment step, the final wire drawing step, the twisting step, the energization heating step and the aging treatment step. That is, in the production method of the aluminum alloy electric wire of this embodiment, the final wire drawing step, the twisting step, and the energization heating step are performed after the solution heat treatment step. In the production method of the aluminum alloy electric wire of this embodiment, the treatment is performed in such an order, whereby the aluminum alloy stranded wire conductor is obtained, and the aluminum alloy strand that composes this aluminum alloy stranded wire conductor has moderate tensile strength and elongation at break.

The obtained aluminum alloy stranded wire conductor serves as a raw material for the aluminum alloy electric wire. The aluminum alloy electric wire usually includes: an aluminum alloy stranded wire conductor (core wire) obtained by twisting a plurality of the aluminum alloy strands; and an insulating resin layer that covers a surface of the aluminum alloy stranded wire conductor. As the resin that composes the insulating resin layer, for example, olefin resin such as crosslinked polyethylene and polypropylene or vinyl chloride can be used. Moreover, the aluminum alloy electric wire may have an electromagnetic wave shielding layer or the like in addition to the stranded wire conductor and the insulating resin layer. As a method for producing the aluminum alloy electric wire by using the aluminum alloy stranded wire conductor obtained by the production method of the present embodiment, a method known in public can be used.

The obtained aluminum alloy electric wire can be used for a vehicle electric wire such as an automotive wire harness, a vehicle component such as a cable, an electric or electronic component such as a power cable and a communication cable, a mechanical component such as an electric wire for an instrument, and a building material.

[Automotive Wire Harness]

The automotive wire harness of this embodiment is an automotive wire harness for which the aluminum alloy electric wire of this embodiment is used. Since the aluminum alloy electric wire according to the present invention is excellent in tensile strength, elongation at break and conductivity and can be made thin, the automotive wire harness of this embodiment can also be reduced in weight by being thinned.

EXAMPLES

Hereinafter, the present invention will be described in more detail by Examples and Comparative Example; however, the present invention is not limited to these examples.

Examples 1 to 5, Comparative Example 1

A first-grade aluminum ingot according to JIS H 2102 was used, and predetermined amounts of Mg and Si were added thereto, and as shown in Table 1, an aluminum alloy with a diameter of 18 mm, which contained 0.8 atomic of Mg and 0.7 atomic % of Si, was obtained. This aluminum alloy was melted by a conventional method, and was processed into a wire rod (aluminum alloy wire rod) with a wire diameter of 9.5 mm by using a continuous casting rolling method. A composition of the aluminum alloy wire rod was the same as that of the aluminum alloy.

Next, this aluminum alloy wire rod was subjected to solution heat treatment of heating the same aluminum alloy wire rod under conditions shown in Table 1 and thereafter water-cooling the same, and a wire (solution-heat-treated wire) with a wire diameter of 9.5 mm, which was subjected to the solution heat treatment, was obtained (solution heat treatment step).

TABLE 1

| | Composition of Added Elements | | Solution Heat Treatment | | Energization Heating | | Aging Condition | |
|---|---|---|---|---|---|---|---|---|
| | Mg (atomic %) | Si | Solution Heat Temperature (° C.) | Solution Heat Time (min.) | Voltage (V) | Time (sec.) | Aging Temperature (° C.) | Aging Time (hrs.) |
| Example 1 | 0.8 | 0.7 | 555 | 30 | 9.2 | 0.3 | 175 | 8 |
| Example 2 | 0.8 | 0.7 | 555 | 30 | 12 | 0.3 | 175 | 8 |
| Example 3 | 0.8 | 0.7 | 555 | 30 | 12 | 0.2 | 175 | 8 |
| Example 4 | 0.8 | 0.7 | 555 | 30 | 12 | 0.3 | 175 | 8 |
| Comparative example 1 | 0.8 | 0.7 | 555 | 30 | — | — | 175 | 8 |

Moreover, this solution-heat-treated wire was drawn by using a continuous drawing machine, and a wire (final drawn wire) drawn to a final wire diameter of φ0.32 mm was obtained (final wire drawing step) . Furthermore, this final drawn wire was twisted by using a twisting machine, and a stranded wire conductor with a cross-sectional area of 0.5 $mm^2$ was obtained (twisting step).

Next, this stranded wire conductor was energization-heated under the conditions shown in Table 1, and an energization-heated stranded wire conductor was obtained (energization heating step). Moreover, this energization-heated stranded wire conductor was subjected to aging treatment under the conditions shown in Table 1, and then an aluminum alloy stranded wire conductor was obtained (aging treatment step). With regard to the aluminum alloy strand that composes the obtained aluminum alloy stranded wire conductor, an average grain size, standard deviation and coefficient of variation of crystal grains observed in a cross section perpendicular to the drawing direction were evaluated. The average grain size, the standard deviation and the grain size distribution were evaluated by using a scanning electron microscopy (SEM) image and electron beam backscatter diffraction (EBSD). A scan step of EBSD was set to 0.2 μm. Moreover, in a grain boundary judgment of EBSD, a portion where an orientation difference between the crystal grains is 2° or more was defined as a grain boundary. The coefficient of variation was calculated by dividing the standard deviation of the grain size of the crystal grains by the average grain size of the crystal grains. Results are shown in Table 2.

Figure 3:
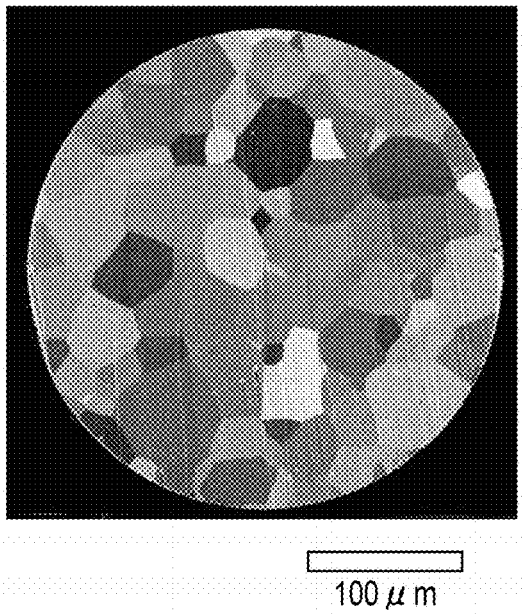
FIG. 3 is an SEM (scanning electron microscope) photograph of a cross section of a wire of an aluminum alloy strand of Example 2.
Figure 5:
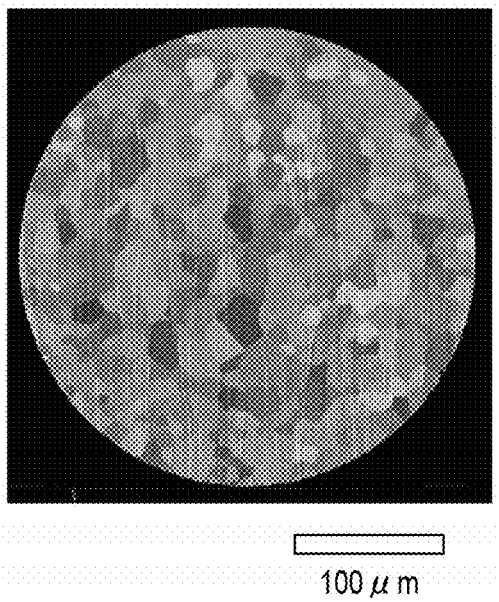
FIG. 5 is an SEM (scanning electron microscope) photograph of a cross section of a wire of an aluminum alloy strand of Example 3.
Figure 7:
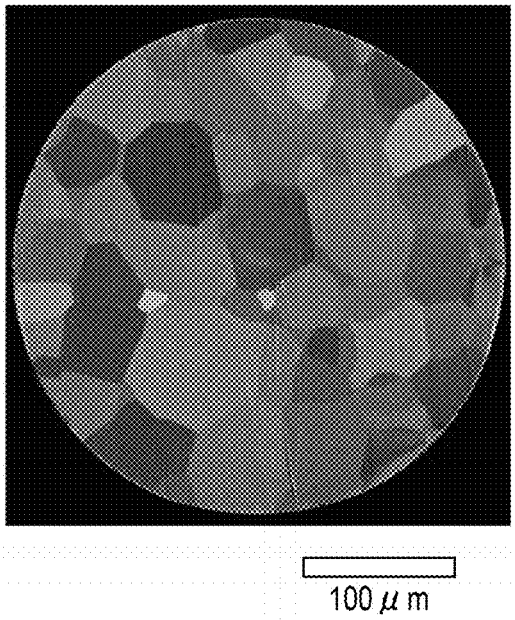
FIG. 7 is an SEM (scanning electron microscope) photograph of a cross section of a wire of an aluminum alloy strand of Example 4.
Figure 9:
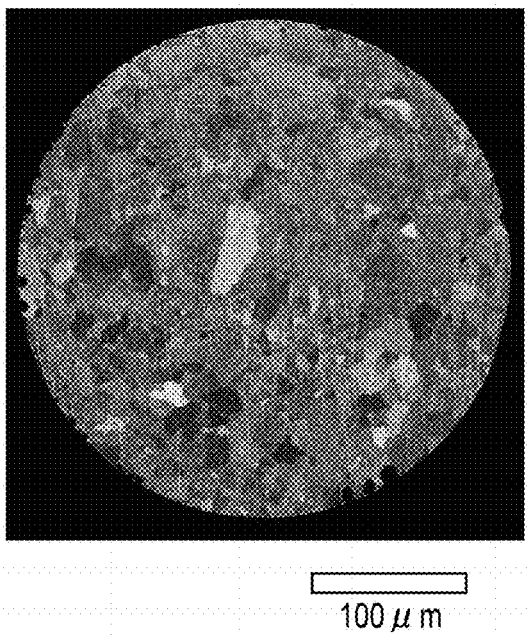
FIG. 9 is an SEM (scanning electron microscope) photograph of a cross section of a wire of an aluminum alloy strand of Comparative example 1.

Moreover, SEM (scanning electron microscope) photographs of the cross sections of the wires are shown in FIG. 1 (Example 1), FIG. 3 (Example 2), FIG. 5 (Example 3), FIG. 7 (Example 4) and FIG. 9 (Comparative example 1).

Figure 2:
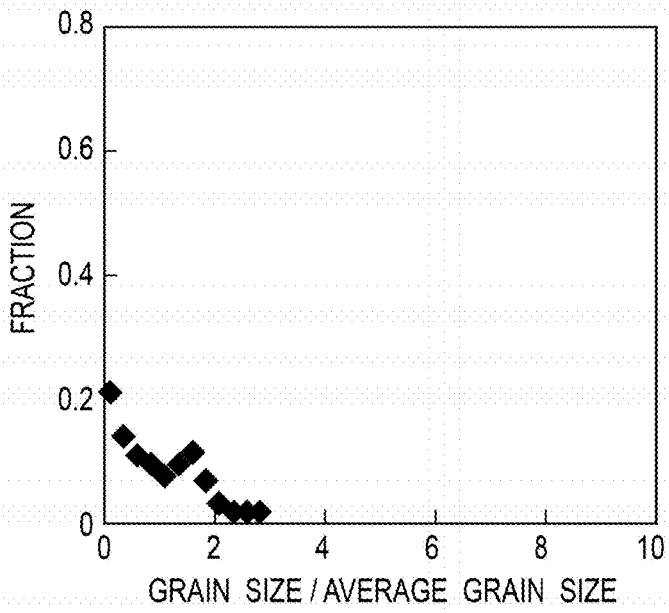
FIG. 2 is a graph showing a relationship between a ratio of a grain size to an average grain size and a fraction in crystal grains on the cross section of the wire of the aluminum alloy strand of Example 1.
Figure 4:
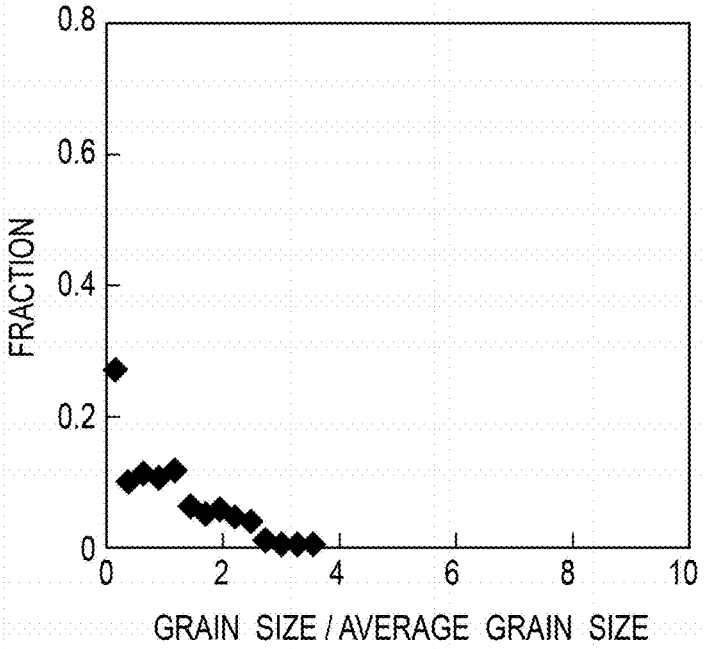
FIG. 4 is a graph showing a relationship between a ratio of a grain size to an average grain size and a fraction in crystal grains on the cross section of the wire of the aluminum alloy strand of Example 2.
Figure 6:
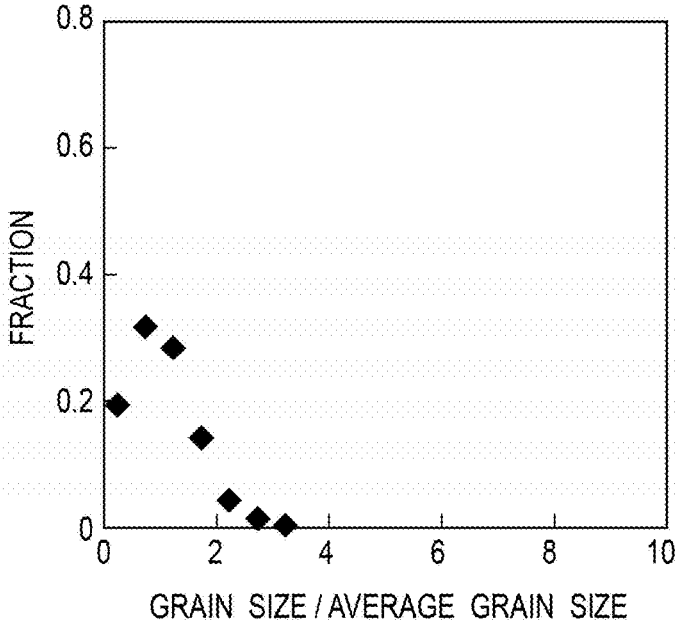
FIG. 6 is a graph showing a relationship between a ratio of a grain size to an average grain size and a fraction in crystal grains on the cross section of the wire of the aluminum alloy strand of Example 3.
Figure 8:
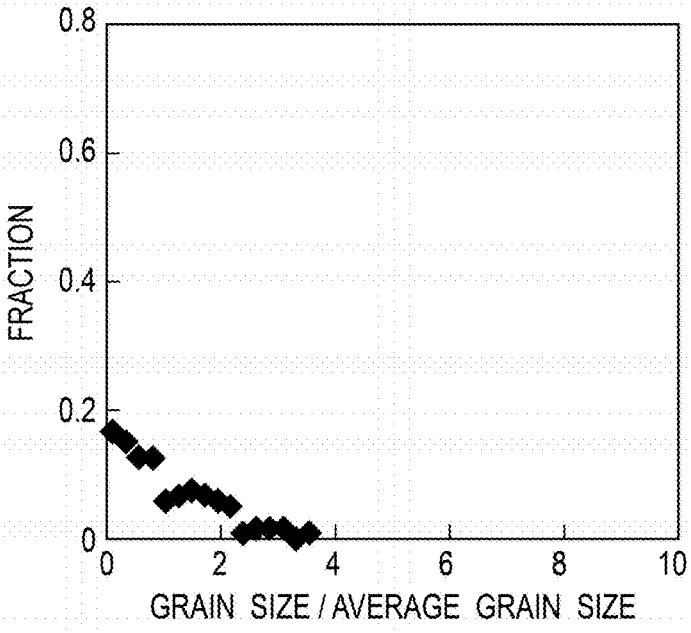
FIG. 8 is a graph showing a relationship between a ratio of a grain size to an average grain size and a fraction in crystal grains on the cross section of the wire of the aluminum alloy strand of Example 4.
Figure 10:
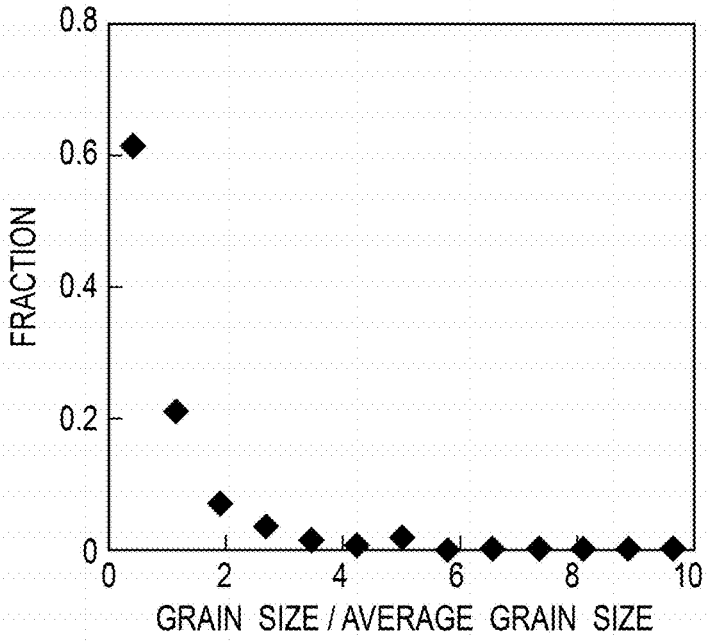
FIG. 10 is a graph showing a relationship between a ratio of a grain size to an average grain size and a fraction in crystal grains on the cross section of the wire of the aluminum alloy strand of Comparative example 1.

Furthermore, with regard to each of Examples 1 to 4 and Comparative example 1, a relationship between a ratio of the grain size to the average grain size and a fraction in the crystal grains on the cross section of the wire was measured. The ratio of the grain size to the average grain size in the crystal grains is an index of an occurrence frequency of the abnormally grown grains. The larger the ratio of the grain size to the average grain size is, the higher the occurrence frequency of the abnormally grown particles is. Moreover, the fraction is a ratio of the number of crystal grains showing a specific grain size to the total number of measured crystal grains. Analysis results of the relationships between the ratios of the grain sizes to the average grain sizes and the fractions in the crystal grains are shown in FIG. 2 (Example 1), FIG. 4 (Example 2), FIG. 6 (Example 3), FIG. 8 (Example 4) and FIG. 10 (Comparative Example 1). From Table 2, FIG. 2, FIG. 4, FIG. 6, FIG. 8 and FIG. 10, it is seen that, in each of Examples 1 to 4, the coefficient of variation is 0.8 or less, a spread of the grain size distribution is small, and the occurrence frequency of the abnormally grown grains is low, and meanwhile, in Comparative example 1, the coefficient of variation exceeds 0.8, the spread of the grain size distribution is large, and the occurrence frequency of the abnormally grown grains is high.

Moreover, with regard to the aluminum alloy strand that composes each of the obtained aluminum alloy stranded wire conductors, tensile strength, elongation at break and conductivity thereof were evaluated in accordance with JIS C 3002. With regard to the conductivity, specific resistance of each of the aluminum alloy strands was measured by using the four-terminal method in a thermostatic oven kept at 20° C. (±0.5° C.), and the conductivity concerned was calculated based on the measured specific resistance. An inter-terminal distance at the time of measuring the specific resistance was set to 1000 mm. The tensile strength and the elongation at break were measured in accordance with JIS Z 2241 under a condition where a tensile speed is 50 mm/min.

From Table 2, it is seen that the aluminum alloy strand in each of Examples is excellent in tensile strength, elongation at break and conductivity in a well-balanced manner.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

INDUSTRIAL APPLICABILITY

In the aluminum alloy electric wire according to the present invention, with regard to the aluminum alloy strand, the tensile strength thereof is 165 MPa or more, the elongation at break thereof is 7% or more, and the conductivity thereof is 40% IACS or more. These characteristics seem to satisfy the properties required for the aluminum alloy strand that composes the aluminum alloy electric wire in which the cross-sectional area of the aluminum alloy stranded wire conductor is 0.5 sq or less. As described above, in accordance with the aluminum alloy electric wire according to the present invention, an excellent balance between the tensile strength, elongation at break and conductivity of the aluminum alloy strand is brought, and accordingly, the aluminum alloy stranded wire conductor can be thinned so that the cross-sectional area thereof can be smaller than 0.75 sq.

Moreover, the automotive wire harness according to the present invention can be reduced in weight by being thinned, and accordingly, is suitable as an automotive wire harness required to be reduced in weight.

The aluminum alloy electric wire of this embodiment can be used, for example, for the automotive wire harnesses.

The invention claimed is:

1. An aluminum alloy electric wire comprising an aluminum alloy strand that comprises magnesium (Mg), silicon (Si) and a remainder comprising of aluminum (Al) and impurities, wherein the aluminum alloy strand comprises 0.60 to 1.4 by atomic percent of Mg and 0.2 to 1.0 by atomic percent of Si, has a coefficient of variation in a range of 0.6 to 0.8, the coefficient of variation being calculated by dividing a standard deviation of a grain size of crystal grains observed on a cross section of the aluminum alloy strand by an average grain size of the crystal grains, has tensile strength of 165 MPa or more,

TABLE 2

| | Aluminum Alloy Strand | | | | | | |
|---|---|---|---|---|---|---|---|
| | | Crystal Grain observed on Cross Section | | | | | |
| | Wire Diameter (mm) | Standard Deviation (μm) | Average Grain Size (μm) | Coefficient of Variation (—) | Tensile Strength (MPa) | Elongation (%) | Conductivity (% IACS) |
| Example 1 | 0.32 | 14.9 | 19.7 | 0.8 | 267 | 12.4 | 49.4 |
| Example 2 | 0.32 | 15.2 | 19.0 | 0.8 | 281 | 10.9 | 49.0 |
| Example 3 | 0.32 | 6.0 | 10.0 | 0.6 | 269 | 14.8 | 46.3 |
| Example 4 | 0.32 | 17.4 | 22.0 | 0.8 | 281 | 11.7 | 49.1 |
| Comparative example 1 | 0.32 | 3.4 | 2.6 | 1.3 | 301 | 3.4 | 50.8 |

has elongation at break of 7 percent or more, and has conductivity of 40 percent IACS or more.

2. An automotive wire harness, comprising the aluminum alloy electric wire according to claim 1.

3. The aluminum alloy electric wire comprising an aluminum alloy strand according to claim 1, wherein the average grain size is in a range of 19.0 to 22.0 micrometers.

4. The aluminum alloy electric wire comprising an aluminum alloy strand according to claim 1, wherein the elongation at break is in a range of 10.9 percent to 14.8 percent.

5. The aluminum alloy electric wire comprising an aluminum alloy strand according to claim 1, wherein the tensile strength is in a range of 267 to 281 MPa.

* * * * *